US005646654A

United States Patent [19]

Widder

[11] Patent Number: 5,646,654

[45] Date of Patent: Jul. 8, 1997

[54] INK-JET PRINTING SYSTEM HAVING ACOUSTIC TRANSDUCER FOR DETERMINING OPTIMUM OPERATING ENERGY

[75] Inventor: John A. Widder, Camas, Wash.

[73] Assignee: Hewlett-Packard Company, Palo Alto, Calif.

[21] Appl. No.: 401,393

[22] Filed: Mar. 9, 1995

[51] Int. Cl.[6] ..... B41J 29/38; B41J 29/393

[52] U.S. Cl. ..... 347/14; 347/19

[58] Field of Search ..... 347/5, 9, 14, 19

[56] References Cited

U.S. PATENT DOCUMENTS

| | | | |
|---|---|---|---|
| 4,509,057 | 4/1985 | Sobi et al. | 346/1.1 |
| 4,580,914 | 4/1986 | Rich et al. | 400/56 |
| 4,697,193 | 9/1987 | Howkins | 346/1.1 |
| 4,849,768 | 7/1989 | Graham | 346/1.1 |
| 4,872,028 | 10/1989 | Lloyd | 346/1.1 |
| 5,287,808 | 2/1994 | Lippold | 101/365 |
| 5,300,968 | 4/1994 | Hawkins | 346/140 R |
| 5,418,558 | 5/1995 | Hock et al. | 347/14 |
| 5,559,535 | 9/1996 | Otsuka et al. | 347/14 |
| 5,596,353 | 1/1997 | Takada et al. | 347/19 |

*Primary Examiner*—Safet Metjahic
*Assistant Examiner*—John Chizmar

[57] ABSTRACT

An ink-jet printing system includes an ink-jet print head having multiple nozzles for ejecting drops of ink onto the recording media to form printed images. The ink-jet print head emits an audible sound during the ejection of an ink droplet, but remains comparatively silent when no ink droplet is ejected. An acoustic detector is provided to detect the audible sound emitted by the ink-jet print head during ejection of the ink droplet. The system further includes an energy control subsystem coupled to supply pulses of operating energy to the print head to cause ejection of the ink droplets. The energy control subsystem is operatively coupled to receive feed back information from the acoustic detector which is then used to adjust the operating energy pulses that are supplied to the print head. The energy control subsystem adjusts the operating energy pulses in a manner that causes the print head to emit audible sounds that are optimized toward approximating an ideal audible sound indicative of optimal operation.

17 Claims, 4 Drawing Sheets

INK-JET PRINTING SYSTEM HAVING ACOUSTIC TRANSDUCER FOR DETERMINING OPTIMUM OPERATING ENERGY

FIELD OF THE INVENTION

This invention relates to ink-jet printers, and particularly, to drop-on-demand ink-jet printers.

BACKGROUND OF THE INVENTION

An ink-jet printer is a type of non-impact printer which forms characters and other images by controllably spraying drops of ink from a print head onto a recording media, such as paper. The print head ejects liquid ink through multiple nozzles in the form of drops which travel across a small air gap to land on the recording media. The drops are very small as ink-jet printers commonly print within a range of 180 to 600 dots per inch (dpi). The ink drops dry shortly thereafter and combine to form the printed image.

There are two major classes of ink-jet printers: drop-on-demand and continuous. Drop-on-demand ink-jet printers eject ink only when ink is required for printing, whereas continuous stream ink-jet printers propel ink in streams and deflect charged drops either toward or away from the media. This invention is particularly directed to drop-on-demand ink-jet printers.

A thermal ink-jet printer is a drop-on-demand printer which uses heat dissipation to form and eject ink drops. A thermal ink-jet print head has multiple drop generators which are used in parallel to increase printing throughput. Ideally, there is a drop generator for each nozzle. Each drop generator includes an ink chamber, a nozzle orifice, and a heating element disposed at the nozzle. Ink droplets are ejected from individual nozzles by localized heating of the associated heating element for the selected nozzles. An electrical current is passed through the associated heating element to heat it up. The current is typically supplied in individual energy pulses of sufficient duration and magnitude to cause deposition of an ink drop. The heat dissipated from the heating element during a "firing pulse" vaporizes a tiny volume of ink in the associated chamber causing the ink to volumetrically expand. This forces unevaporated ink through the respective nozzle toward the recording media. Contraction of the vapor bubble contributes to breakoff of the ejected ink to form a drop which continues its path to the media.

One problem associated with ink-jet printers concerns the amount of ink deposited from the print head during formation of each drop. The quantity of deposited ink, commonly referred to as "drop-volume", significantly contributes to print quality. Low drop-volume results in poor quality images which appear faint or washed out. Conversely, high drop-volume yields poor quality images which appear too dark or have poor resolution. High drop-volume also increases the amount of time necessary for the image to dry.

Drop-volume is dependent on the temperature of the print head which, in turn, is based upon the amount of energy applied during the firing pulses. The amount of energy applied to nozzle heating elements needs to be controlled to produce the desired drop-volume for ensuring high quality images. If too little energy is applied, the print head is cooler and deposits less ink, thereby resulting in a low drop-volume. If too much energy is applied, the print head becomes exceedingly warm and deposits too much ink, thereby resulting in a high drop-volume. Additionally, excessive high energy can damage the print head.

The deposition characteristics of an individual droplet ejected from a drop generator can be controlled by manipulating the amount of energy applied to the associated heating element during a firing pulse. There is a threshold point of energy above which a drop is ejected, and below which no drop is ejected. The threshold point can be used to derive an optimum operating range for drop generator. Ideally, the drop generator is operated above its threshold point at a point that deposits the desired drop-volume.

Designers have proposed various techniques to derive and control the appropriate amount of energy which causes ejection of an optimal droplet. U.S. Pat. No. 4,872,028 to Lloyd, and also assigned to Hewlett-Packard Company, describes a thermal ink-jet print system that has a piezo-electric drop detector which is used to help determine an optimal drive pulse. The drop detector is located within a maintenance station to the side of the media path.

During a startup routine, the print head is moved to the maintenance station to undergo an operating energy calibration test. A test generator supplies a series of energy pulses of fixed amplitude and successively increasing pulse widths to the print head. The test pattern contains both pulses having insufficient energy to produce a detectable drop (i.e., below the threshold point) as well as pulses having enough energy to cause deposition of a detectable drop. When ejected, the drops collide with the piezo-electric membrane of the drop detector causing generation of an electric signal indicating that a drop was ejected. The feed back from the piezo-electric drop detector is analyzed by a microprocessor in relation to the energy pulse test pattern to derive an optimum operating energy.

U.S. Pat. No. 4,509,057 to Sohl et al. describes a technique for automatically calibrating a drop-on-demand ink-jet print head using an optical drop detector. The optical drop detector includes a light emitter which directs a light beam toward a light detector. The light beam is positioned adjacent to the print head nozzle so that a properly ejected droplet passes substantially through the light beam, thereby interrupting it. The interruption to the light beam is sensed by the detector to monitor when an ink droplet is ejected. In addition to detecting when a print head is firing, the optical detector can help determine horizontal errors in drop position by relating the position of the nozzle to the amount of light blocked by the droplet. Additionally, the velocity of the droplet can be determined by measuring the amount of time elapsed between droplet ejection and droplet detection.

The piezo-electric and optical drop detectors of prior art solutions have a significant drawback in that they can become contaminated with ink. With respect to the piezo-electric drop detector, the membrane is directly coated with ink when the droplets impact the membrane during testing. For the optical drop detector, it is closely situated near the droplet path and can become covered with ink aerosol which consists of tiny droplets of ink that are discharged during ejection of an ink droplet. Over time, the ink aerosol accumulates and begins to cover the optical detector or emitter, impairing or blocking the light beam. As a result of this ink contamination, there is a possibility that the performance of a piezo-electric detector or an optical detector will degrade over time.

It is therefore an object of this invention to provide a drop-on-demand ink-jet printer having a drop detection system for determining an optimal operating energy that will not be degraded by ink contamination.

SUMMARY OF THE INVENTION

According to an aspect of this invention, an ink-jet printing system is provided that has a remote drop detector which effectively and efficiently detects when an ink-jet print head is properly ejecting ink, without being subjected to ink contamination.

The ink-jet printing system includes an ink-jet print head having multiple nozzles for ejecting drops of ink onto the recording media to form printed images. The ink-jet print head emits an audible sound during the ejection of an ink droplet, but remains comparatively silent when no ink droplet is ejected. An acoustic detector is provided to detect the audible sound emitted by the ink-jet print head during ejection of the ink droplet. The system further includes an energy control subsystem coupled to supply pulses of operating energy to the print head to cause ejection of the ink droplets. The energy control subsystem is operatively coupled to receive feed back information from the acoustic detector which is then used to adjust the operating energy pulses that are supplied to the print head. The energy control subsystem preferably adjusts the operating energy pulses in a manner that causes the print head to emit audible sounds that are optimized toward approximating an ideal audible sound.

According to another aspect of this invention, the ink-jet print head can be calibrated during a test mode to an optimum operating energy. During the test mode, the energy control subsystem supplies a series of energy pulses with varying amounts of energy to the print head. Some of the energy pulses have insufficient energy to cause the print head to eject an ink droplet while other energy pulses have sufficient energy to cause ejection of an ink droplet. The acoustic detector is operable during the test mode to detect the audible sounds when the print head begins to eject ink droplets. The energy control subsystem uses the feed back from the acoustic detector to identify one or more operating energy pulses that are effective to cause ejection of an ink droplet.

According to another aspect of this invention, the acoustic feed back system can be used to detect when the print head is beginning to run out of ink. The ink-jet print head emits an appreciable audible sound when it ejects ink droplets and a non-appreciable sound when it fires, but fails to eject ink droplets due to an empty ink supply. The acoustic detector detects a transition between the appreciable and non-appreciable sounds. This information is used by the energy control subsystem to determine when the ink-jet print head is out of ink based.

According to still other aspects of this invention, methods for determining an operating energy for an ink-jet print head are described.

DESCRIPTION OF THE DRAWINGS

Preferred embodiments of the invention are described below with reference to the following accompanying drawings depicting examples embodying the best mode for practicing the invention.

FIG. 1 shows a movable carriage holding a print head and an acoustic detector.

DETAILED DESCRIPTION OF THE INVENTION

The present invention relates to drop-on-demand ink-jet printing systems which can be used in many different printing devices, including ink-jet printers, plotters, scanners, facsimile machines, and the like. In general, an ink-jet printing system has one or more ink-jet print heads which controllably deposit drops of ink in prescribed patterns onto a recording media. As used herein, recording media includes all forms of printable matter including, for example, continuous paper, sheet stock paper, adhesive backed labels, mylar, and the like. Tills invention is primarily well suited for use with thermal ink-jet print heads. A typical thermal ink-jet print head has multiple nozzles (e.g., 50 nozzles), such as that described in U.S. Pat. No. 5,278,584 by Keefe et al., which is assigned to Hewlett-Packard Company. It is also believed that the invention can be used with piezo-electric ink-jet print heads. Thermal and piezo-electric ink-jet print heads and their operation are well known and will not be described in detail in this disclosure.

It is additionally noted that this invention can be used in different constructions of ink-jet printing systems, such as shuttle-type printing systems and fixed print head systems. For purposes of continuing discussion, however, this invention is described in the context of a shuttle-type, drop-on-demand, thermal ink-jet printing system.

Figure 1:
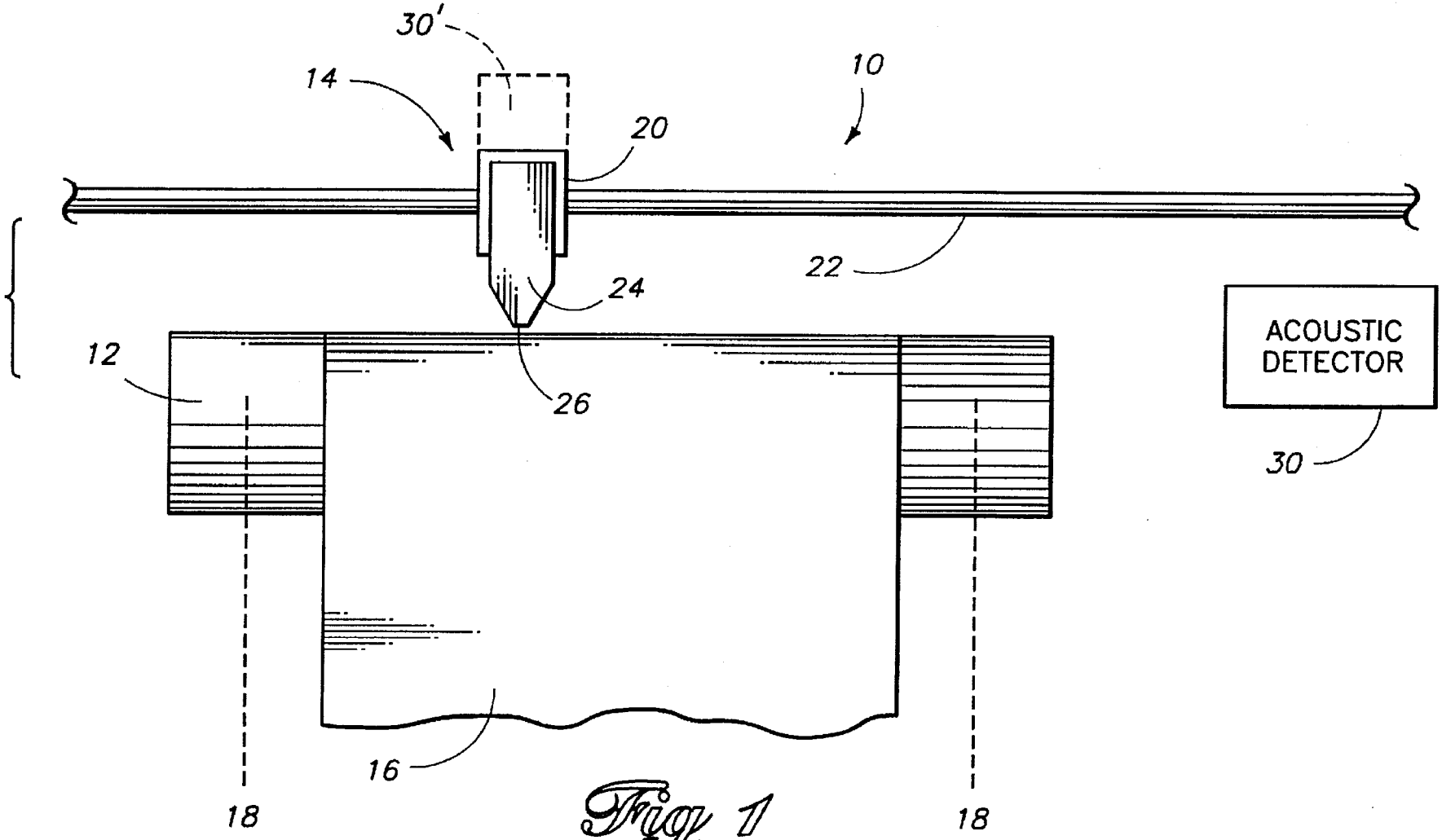
FIG. 1 is a diagrammatical view of one form of an ink-jet printing system according to this invention.

FIG. 1 shows a shuttle-type thermal ink-jet printing system 10 constructed according to this invention. Printing system 10 includes a platen 12 and a shuttle assembly 14. Platen 12 supports a recording media 16 during printing. The platen can be stationary, or rotatable to assist in advancing the media through the printing mechanism. A media feed mechanism (not shown), such as conventional friction rollers or a tractor feed system, may be used to drive the media through the printing mechanism along a media feed path.

Printing system 10 has a predefined print zone which is represented by dashed boundary lines 18. The print zone coincides at least partially with the media feed path so that the recording media is fed through the print zone. An example print zone is defined as an area within which each of the multiple print heads can print across the entire width of the recording media.

Shuttle assembly 14 includes a carriage 20 slidably mounted on a fixed, elongated guide rod 22 to move bidirectionally across platen 12. Carriage 20 is designed to maneuver over the full width of the platen, thereby entirely traversing print zone 18, as well as moving outside of the print zone such as to a maintenance station (not shown). A typical maintenance station has spittoon, wiper, and priming facilities that help prepare a print head for quality printing or periodically service it during operation.

Shuttle assembly 14 includes a drive subassembly (not shown) that is mechanically coupled to drive carriage 20 back and forth along guide rod 22. One typical drive subassembly includes a wire or belt attached to carriage 20 and wound around opposing pulleys, and a motor (e.g., a stepper motor or DC motor) connected to power one of the pulleys. A rotary encoder is coupled to the motor drive shaft to monitor incremental shaft rotation and provide feed back data for use in positioning and controlling the carriage. The shuttle assembly 14 described herein is provided for explanation purposes and its construction is well known in the art. Other types of shuttle assembly configurations may alternatively be employed in the context of this invention.

Carriage 20 supports and carries at least one print head 24 which is preferably embodied as a replaceable, disposable print cartridge or pen. Print head 24 is mounted to carriage 20 so that its nozzle section 26 is adjacent to, but spaced from, platen 12 to permit passage of the recording media therebetween. The carriage 20 moves the print head back and forth through print zone 18 in horizontal swaths along a scan axis. Carriage 20 is also designed to move print head 24 out of print zone 18 to a maintenance station where the print head is serviced.

Print head 24 can be embodied as a mono-color pen which deposits a single ink color, such as black, or as a multi-color pen which deposits multiple colors, such as Cyan, Magenta, and Yellow. An example multi-color print head is sold by Hewlett-Packard under part number 51625A.

According to this invention, ink-jet printing system 10 also includes an acoustic detector 30. During operation, the ink-jet print head 24 emits an audible sound during the ejection of an ink droplet. When the print head is properly functioning, the audible sound is clear and distinct. In contrast, when ink-jet print head 24 is not ejecting ink, it is substantially silent. Acoustic detector 30 is configured to detect the audible sound emitted by the ink-jet print head during ejection of the ink droplet.

Acoustic detector 30 is shown at a remote location from the ink-jet print head 24 outside of print zone 18. From this remote location, the acoustic detector can detect the audible sounds emitted by the ink-jet print head during ejection of ink droplets, but is far enough away to avoid ink contamination from ink aerosol. This remote location is particularly well suited for periodic monitoring of the print head at selected times. Specifically, optimal detection occurs when the print head is firing, but the carriage and media handling mechanisms are stationary. This helps reduce interference from ambient noises produced by these other printer mechanisms.

In an alternative embodiment, the acoustic detector can be mounted adjacent to the ink-jet print head, such as on carriage 20 as represented by dashed box 30'. At this location, the detector is always situated at a fixed distance from the print head to enable continuous monitoring. Yet, the detector is still positioned away from the nozzles and ink drop path to avoid ink contamination.

Figure 2:
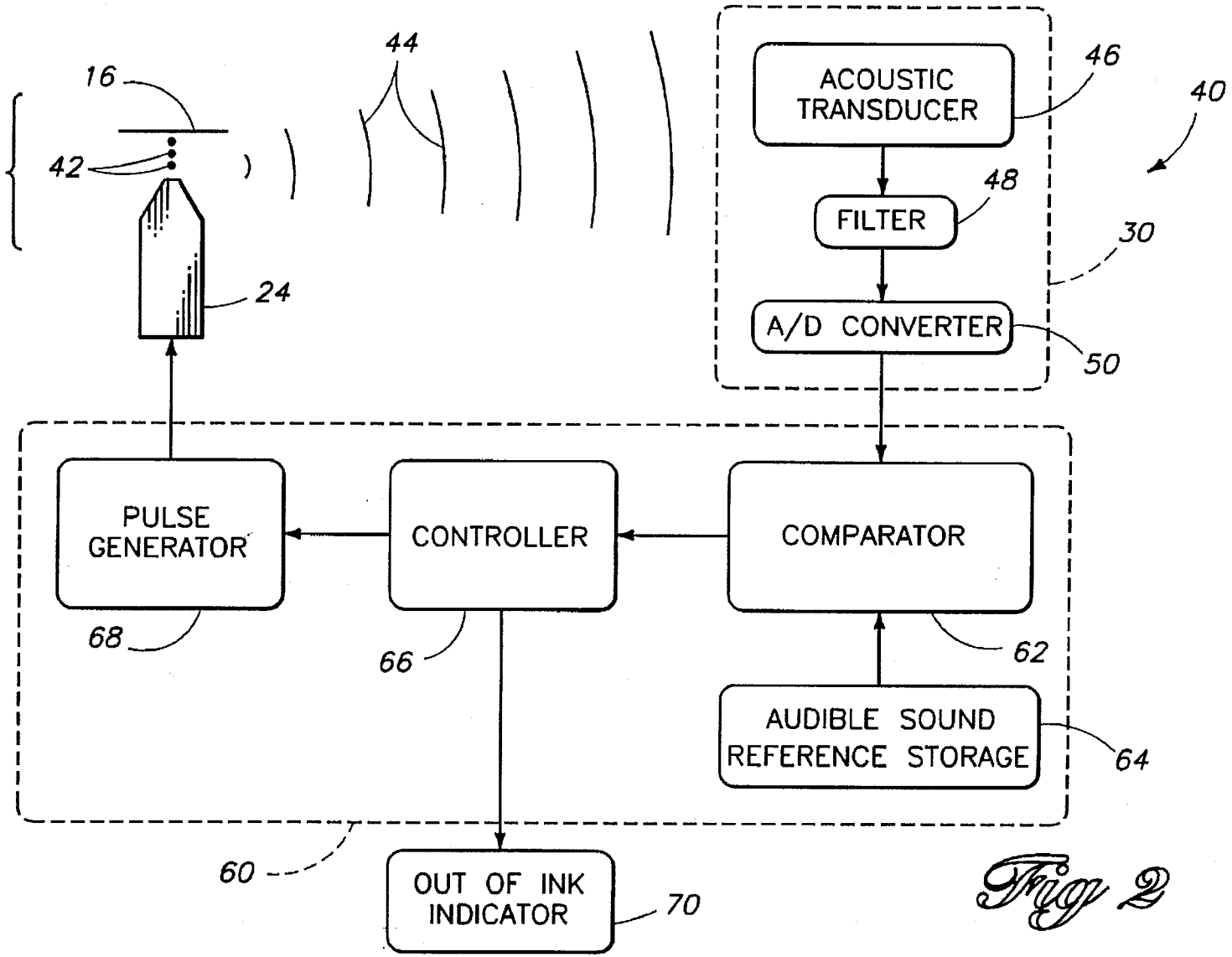
FIG. 2 is a block diagram of an acoustic feed back system used in controlling the ink-jet printing system of this invention.

FIG. 2 shows an acoustic feed back ink-jet printing system 40 for determining an optimal operating energy for ink-jet print head 24 according to this invention. Print head 24 is illustrated as ejecting discrete droplets 42 onto media 16. Upon ejection, the print head emits a clear and distinct audible sound as represented by sound waves 44. Acoustic detector 30 detects sound waves 44.

In the illustrated embodiment, acoustic detector 40 includes an acoustic transducer 46 that produces a variable analog voltage in response to sound waves 44. The analog signal is passed through filter 48 and converted by analog-to-digital (A/D) converter 50 to a digital signal. Filter 48 can be specially designed to pass certain predetermined frequency ranges and harmonics representative of a normal functioning ink-jet print head. According to the implementation of FIG. 2, acoustic detector 30 outputs an actual digital signal indicative of the audible sound emitted by the print head.

System 40 further includes an energy control subsystem 60 which supplies pulses of operating energy to ink-jet print head 24 to cause ejection of ink droplets 42. Energy control subsystem is also coupled to receive the digital signal from acoustic detector 30. In this manner, energy control subsystem 60 can adjust the operating energy pulses supplied to print head 24 in response to acoustic feed back information from the acoustic detector 30.

In this embodiment, energy control subsystem 60 includes a comparator 62, an audible sound reference storage 64, a controller 66, and a pulse generator 68. Comparator 62 receives the actual signal from acoustic detector 30 and compares it to a reference signal kept in storage 64. The reference signal is indicative of an audible sound of an ejecting print head that is operating under optimal energy.

Comparator 62 outputs a comparison signal representing any difference between the actual and reference signals. The comparison signal is input to controller 66 and used as a feed back error to adjust energy supplied to the print head. More specifically, controller 66 derives an operating energy adjustment command in response to the comparison signal that is used to adjust the quantity of energy applied in each pulse produced by pulse generator 68. The quantity of energy can be increased or decreased within each pulse by manipulating the pulse amplitude, pulse duration, or both. Pulse generator 68 outputs a desired series of pulses in accordance with the commands received from controller 66.

In an alternative embodiment to that illustrated in FIG. 2, an FFT (Fast Fourier Transform) is substituted for filter 48 and A/D converter 50 to spectrally analyze the analog signal from the acoustic transducer. The FFT derives frequency and harmonic information of the audible sound. The measured frequency and harmonics is compared by comparator 62 to a range of acceptable reference frequencies (kept in storage 64) to produce the comparison signal used by controller 66.

In still another embodiment, storage 64 can be used to keep an optimum operating energy transfer function of an ink-jet print head which relates audible sounds emitted during firing to a quantity of pulse energy. Example transfer functions that relate other ink-jet print head characteristics to operating parameters are described in U.S. Pat. No. 4,872,028 to Lloyd, and also assigned to Hewlett-Packard Company, which is hereby incorporated by reference. For example, the U.S. Pat. No. 4,872,028 patent describes transfer functions which relate drop speed to pulse width, and which relate drop volume to pulse amplitude. In the present invention, a transfer function relating audible sounds emitted by a particular type print head to a quantity of energy in the firing pulse can be experimentally ascertained and used to control operation of the print head.

Figure 3:
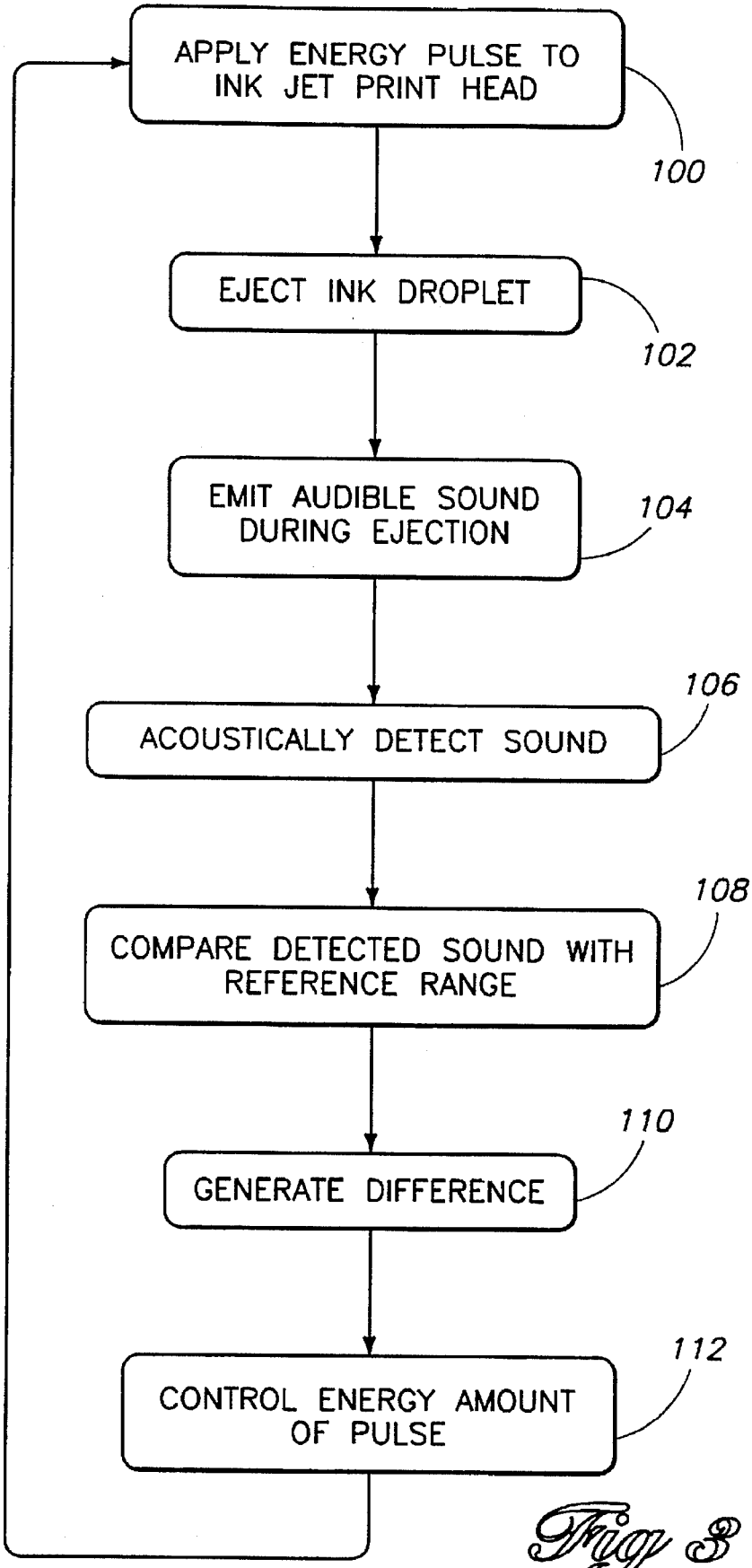
FIG. 3 is a flow diagram of a method for determining an operating energy of an ink-jet print head.

FIG. 3 shows a method for determining an operating energy for an ink-jet printer according to another aspect of this invention. At step 100, an operating energy is applied to ink-jet print head 24. Depending upon the amount of energy, print head 24 either ejects or does not eject ink droplets (step 102). In the event that the energy is sufficient to cause ejection of an ink droplet, the print head emits an audible sound (step 104).

At step 106, acoustic detector 30 detects the audible sound emitted from print head 24 during ejection. This audible sound is compared to a reference range of audible sounds held in reference storage 64 (step 108) and a difference signal is generated by comparator 62 (step 110). In response to the difference signal, controller 66 manipulates pulse generator 68 to produce a pulse of effective energy that causes the print head to emit an audible sound that is optimized to coincide with the reference range of audible sounds (step 112).

Figure 4:
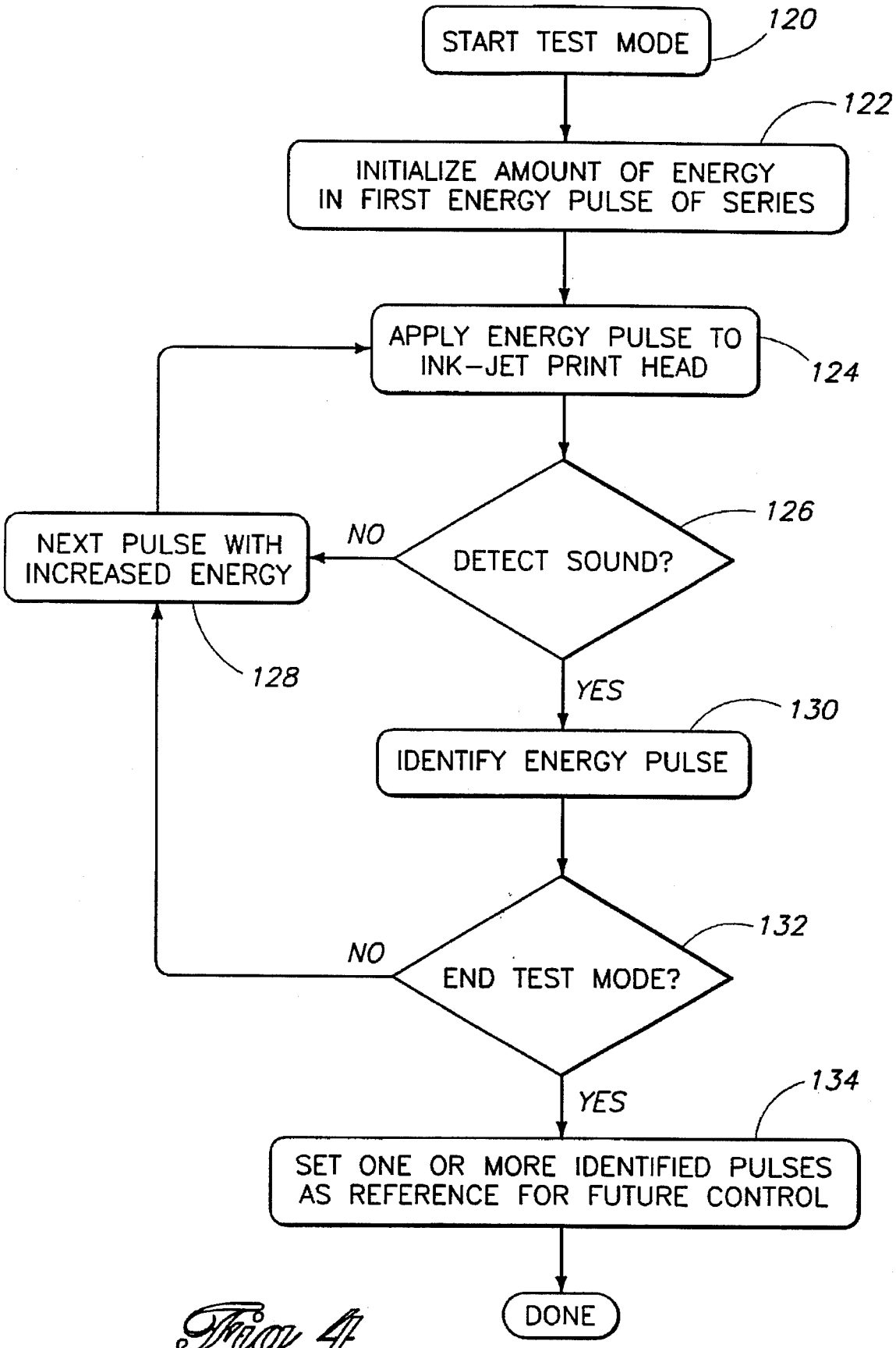
FIG. 4 is a flow diagram of a method for initially determining a suitable range of operating energies for an ink-jet print head.

According to another aspect of this invention, the ink-jet printing system can be operated in an initializing test mode to calibrate the print head for optimal operation. FIG. 4 shows a method for initially determining an operating energy for an ink-jet print head. According to this method, a series of energy pulses of variable amounts of energy are applied to the ink-jet print head. After the test mode is commenced (step 120), the amount of energy in a first energy pulse of the series is initialized (step 122). For explanation purposes, suppose that the initial energy pulse has an insufficient amount of energy to cause the print head to fire. Further suppose that the series includes pulses of successively increasing amounts of energy.

At step 124, the energy pulse is applied to the print head. At step 126, it is determined whether the print head emitted a detectable audible sound. When there is sufficient energy in the pulse, the print head ejects an ink droplet and emits an audible sound which can be detected by acoustic detector 30. With the first pulse, however, the energy is insufficient to cause ejection, and hence there is no appreciable audible sound to detect. Accordingly, flow branches to step 128 to select a next pulse in the series which has a slightly increased amount of energy in comparison to the initial pulse. This next pulse is then applied to the print head (step 124). This small loop continues until energy pulses of sufficient energy to cause ejection of an ink drop are applied to the print head, thereby creating audible sounds.

Once audible sounds are detected (i.e., the "yes" branch from step 126), the energy pulses that cause ejection of ink droplets are identified (step 130). The initial energy pulses that cause droplet ejection approximate a threshold point above which drops are ejected, and below which no drops are ejected. The test continues at step 132 with energy pulses of successively higher quantities of energy to identify an appropriate range of operating energies. Once the test mode is completed (i.e., the "yes" branch from step 132), the identified pulses that cause ejection of ink droplets can be used as reference values for future control (step 134).

It is noted that the transition from no appreciable sound to an appreciable audible sound occurs over several energy pulses. That is, during a series of increasing energy pulses, there might be a time when less than all nozzles are firing, causing some audible sound, but not the desired full sound. In one implementation, the amplitudes of all detected sounds can be measured and plotted to accurately determine when the print head is operating at an optimum energy.

It is also noted that the above method can be easily modified to use a series of energy pulses having successively less energy. The series of pulses can even have random amounts of energy, although monotonically increasing or decreasing energy pulse series are more preferred.

According to yet another aspect of this invention, and with reference again to FIG. 2, system 40 can be configured to detect when ink-jet print head 24 runs out of ink. Ink-jet print head 24 emits an appreciable audible sound when it ejects an ink droplet and a non-appreciable sound when it fires but fails to eject an ink droplet due to an empty ink supply. The non-appreciable sound has a significantly lower amplitude than that of the appreciable audible sound. Acoustic detector 30 can be configured to detect a change in amplitude between the appreciable audible sound and the non-appreciable sound. Upon transition from the appreciable audible sound to the non-appreciable sound, the energy control subsystem determines that the ink-jet print head is beginning to run out of ink. At that point, the energy control subsystem outputs a warning signal activating an out of ink indicator 70 to inform the user.

The ink-jet printing system of this invention is advantageous in that it provides a remote, acoustic drop detector that effectively and efficiently detects when an ink-jet print head is properly ejecting ink. Because the acoustic detector senses sound waves, it does not need to be located near the ink-jet nozzles to directly sense the ink droplets themselves. As a result, and unlike prior art piezo-electric and optical detectors, the acoustic detector does not become contaminated over time by the ink or aerosol. Accordingly, there is no performance degradation due to ink buildup.

Another benefit of this invention is that the acoustic feed back system can be used to monitor print head during normal operation without requiring the print head to be in a special test mode, or positioned at a specific location (such as the maintenance station).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An ink-jet printing system comprising:

an ink-jet print head having multiple nozzles for ejecting drops of ink onto the recording media to form printed images, the ink-jet print head emitting an audible sound during the ejection of an ink droplet;

an acoustic detector to detect the audible sound emitted by the ink-jet print head during ejection of the ink droplet; and an energy control subsystem coupled to supply pulses of operating energy to the print head to cause ejection of the ink droplets, the energy control subsystem being operatively coupled to receive feed back information from the acoustic detector, the energy control subsystem adjusting the operating energy pulses that are supplied to the print head in response to the feed back information from the acoustic detector.

2. An ink-jet printing system as recited in claim 1 wherein the acoustic detector is located remotely from the ink-jet print head to avoid ink contamination.

3. An ink-jet printing system as recited in claim 1 wherein the acoustic detector is located adjacent to the ink-jet print head, but away from the nozzles to avoid ink contamination.

4. An ink-jet printing system as recited in claim 1 wherein the energy control subsystem is configured to adjust the operating energy pulses in a manner that causes the print head to emit audible sounds that are optimized toward approximating an ideal audible sound.

5. An ink-jet printing system as recited in claim 1 wherein:

the ink-jet print head emits an appreciable audible sound when ejecting ink droplets and a non-appreciable sound when firing but not ejecting ink droplets due to an empty ink supply;

the acoustic detector being configured to detect the appreciable audible sound; and the energy control subsystem being configured to determine when the ink-jet print head is out of ink based upon a change from the appreciable audible sound to the non-appreciable sound.

6. An ink-jet printing system as recited in claim 1 wherein:

the acoustic detector outputs an actual signal indicative of the audible sound emitted by the print head; and the energy control subsystem comprises:

an audible sound reference source to provide a reference signal indicative of an audible sound of an ejecting print head that is operating under optimal energy;

a comparator coupled to receive and compare the actual and reference signals, the comparator outputting a comparison signal representing any difference between the actual and reference signals; and a controller coupled to receive the comparison signal and to derive an operating energy adjustment command used to adjust the operating energy pulses that are supplied to the print head in response to the comparison signal received from the comparator.

7. An ink-jet printer comprising the ink-jet printing system recited in claim 1.

8. An ink-jet printing system comprising:

an ink-jet print head having multiple nozzles for ejecting drops of ink onto the recording media to form printed images, the ink-jet print head emitting an audible sound during the ejection of an ink droplet while remaining comparatively silent when no ink droplet is ejected;

an acoustic detector to detect the audible sound emitted by the ink-jet print head during ejection of the ink droplet, the acoustic detector outputting a detection signal when the audible sound is detected;

an energy control subsystem coupled to supply pulses of operating energy to the print head to cause ejection of the ink droplets, the energy control subsystem being responsive to the detection signal from the acoustic detector;

the energy control subsystem being operable during a test mode to supply a series of energy pulses with varying amounts of energy whereby some of the energy pulses have insufficient energy to cause the print head to eject an ink droplet while other energy pulses have sufficient energy to cause ejection of an ink droplet; and the acoustic detector being operable during the test mode to detect the audible sounds when the print head begins to eject ink droplets, the energy control subsystem identifying one or more operating energy pulses that are effective to cause ejection of an ink droplet as detected by the acoustic detector.

9. An ink-jet printing system as recited in claim 8 wherein the acoustic detector is located remotely from the ink-jet print head to avoid ink contamination.

10. An ink-jet printing system as recited in claim 8 wherein the acoustic detector is located adjacent to the ink-jet print head, but away from the nozzles to avoid ink contamination.

11. An ink-jet printing system as recited in claim 8 wherein:

the ink-jet print head emits an appreciable audible sound when ejecting ink droplets and a non-appreciable sound when firing but not ejecting ink droplets due to an empty ink supply; and the acoustic detector is operable during a printing mode to detect a change in sounds emitted by the print head from the appreciable audible sound to the non-appreciable sound to monitor when the ink-jet print head begins to run out of ink.

12. An ink-jet printer comprising the ink-jet printing system recited in claim 8.

13. A method for determining an operating energy for an ink-jet print head comprising the following steps:

applying an operating energy to an ink-jet print head;

selectively ejecting or not ejecting ink droplets from the print head in response to the operating energy applied to the ink-jet print head;

emitting an audible sound from the ink-jet print head when an ink droplet is ejected;

acoustically detecting the audible sound emitted during ejection; and controlling the operating energy to the print head based upon the audible sound that is acoustically detected.

14. A method as recited in claim 13 and further comprising the additional steps:

providing a reference range of audible sounds indicative of an ejecting print head that is operating under optimal energy conditions;

comparing the audible sound that is detected acoustically with the reference range of audible sounds; and controlling the operating energy to the print head to enable the print head to emit an audible sound during ejection that coincides with the reference range of audible sounds.

15. A method as recited in claim 13 and further comprising the following additional steps:

emitting an appreciable audible sound from the ink-jet print head when an ink droplet is ejected;

emitting a non-appreciable sound from the ink-jet print head when it fires but fails to eject an ink droplet; and acoustically detecting a change from the appreciable audible sound to the non-appreciable sound to monitor when the ink-jet print head begins to run out of ink.

16. A method for determining an operating energy for an ink-jet print head comprising the following steps:

applying a series of energy pulses to an ink-jet print head;

varying an amount of energy within the energy pulses whereby some of the energy pulses have insufficient energy to cause the print head to eject an ink droplet while other energy pulses have sufficient energy to cause ejection of an ink droplet;

selectively ejecting an ink droplet from the ink-jet print head in response to an energy pulse of sufficient energy or not ejecting an ink droplet from the ink-jet print head in response to an energy pulse of insufficient energy;

emitting an audible sound when an ink droplet is ejected;

acoustically detecting the audible sound caused by ejection of the ink droplet; and identifying at least one energy pulse in the series of energy pulses that is effective to cause ejection of an ink droplet and emission of a detectable audible sound.

17. A method as recited in claim 16 and further comprising the following additional steps:

setting the detectable audible sound associated with the at least one energy pulse as a reference audible sound; and controlling an amount of energy supplied in energy pulses to the print head to enable the print head to emit an audible sound during ejection that approximates the reference audible sound.

* * * * *